US007350385B1

(12) United States Patent
Book

(10) Patent No.: US 7,350,385 B1
(45) Date of Patent: Apr. 1, 2008

(54) SEPARABLE CONNECTOR FOR KEY RINGS AND SIMILAR ARTICLES

(76) Inventor: Steven C. Book, Suite D, 16th Floor, Flourish Manufactory Centre, 18 Tai Lee Street, Yuen Long, N.T. (HK)

( * ) Notice: Subject to any disclaimer, the term of this patent is extended or adjusted under 35 U.S.C. 154(b) by 0 days.

(21) Appl. No.: 11/475,325

(22) Filed: Jun. 26, 2006

Related U.S. Application Data

(60) Provisional application No. 60/698,296, filed on Jul. 11, 2005.

(51) Int. Cl.
*A44B 15/00* (2006.01)
*A45C 11/32* (2006.01)

(52) U.S. Cl. ..... 70/456 R; 24/3.6; 24/576.1; 24/586.11; 24/615; 24/DIG. 38; 70/459; 206/37.5; 206/37.7

(58) Field of Classification Search ..... 70/456 R, 70/457, 458–460; D3/207, 208, 210; 24/3.6, 24/586.1, 586.11, 576.1, 587.12, 589.1, 614, 24/615, DIG. 38, DIG. 42; 206/37.1, 38.1, 206/37.4–37.8
See application file for complete search history.

(56) References Cited

U.S. PATENT DOCUMENTS

| | | | | | |
|---|---|---|---|---|---|
| 1,199,690 | A | | 9/1916 | Gillan | |
| 2,274,820 | A | * | 3/1942 | Bills | 70/456 R |
| 2,599,660 | A | | 6/1952 | Poutinen | |
| 2,676,822 | A | | 4/1954 | Modrey | |
| 2,702,928 | A | | 3/1955 | Nielsen | |
| 2,975,497 | A | | 3/1961 | Budreck | |
| 3,041,697 | A | * | 7/1962 | Budreck | 24/303 |
| 3,520,033 | A | * | 7/1970 | Usuda | 24/590.1 |
| 3,600,917 | A | | 8/1971 | Krock | |
| 3,765,062 | A | * | 10/1973 | Cruse | 24/587.12 |
| 3,836,049 | A | * | 9/1974 | Smith | 24/587.12 |
| 3,863,477 | A | * | 2/1975 | Klein | 70/456 R |
| 3,979,801 | A | * | 9/1976 | Tareau | 24/587.12 |
| 3,979,934 | A | | 9/1976 | Isenmann | |
| 4,248,071 | A | * | 2/1981 | Kussoy | 70/456 R |
| 4,309,883 | A | * | 1/1982 | Brentini | 70/456 R |
| 4,422,315 | A | | 12/1983 | Klose | |
| 4,474,043 | A | * | 10/1984 | Morrone, III | 70/456 R |
| 4,569,106 | A | * | 2/1986 | Lovato | 24/615 |
| 4,581,910 | A | | 4/1986 | Brooks et al. | |
| 4,621,393 | A | * | 11/1986 | Ambal | 24/171 |
| 4,713,951 | A | | 12/1987 | Ros | |
| 4,776,191 | A | | 10/1988 | MacDonald | |
| D310,753 | S | | 9/1990 | Stillwagon et al. | |

(Continued)

*Primary Examiner*—Lloyd A. Gall
(74) *Attorney, Agent, or Firm*—Todd N. Hathaway

(57) ABSTRACT

A separable, pull-apart key holder formed of two identically-shaped pieces. The pieces are mounted together in reversed, face-to-face relationship. The pieces are formed of a strong, rigid resiliently flexible plastic material, such as molded polycarbonate or nylon. Each includes a flat, plate-shaped body having a generally planar bearing surface on one side. Projecting tongues formed at one end of the bearing surfaces are received in openings formed at the opposite ends of the bearing surfaces. Locking notches snap into engagement to prevent accidental separation of the pieces after they have been pressed together. The pieces can be intentionally separated by simply pulling them apart with a quick tug or pull, causing the locking notches to deflect resiliently and release. The pieces are reassembled by simply pressing or sliding them together, longitudinal alignment between the parts being established by interfitting ribs and channels on the bearing surfaces.

14 Claims, 4 Drawing Sheets

U.S. PATENT DOCUMENTS 5,069,050 A * 12/1991 Chen ..... 70/456 R
5,203,058 A * 4/1993 Krauss ..... 24/587.12
5,224,247 A * 7/1993 Collier ..... 24/587.12
5,261,257 A 11/1993 Collier
5,520,036 A * 5/1996 Collier ..... 70/456 R
5,735,024 A * 4/1998 Ortiz ..... 24/573.11
5,845,373 A * 12/1998 Langer ..... 24/303
6,571,434 B2 * 6/2003 Ortiz ..... 24/615
6,622,350 B2 * 9/2003 Austin et al. ..... 24/312
6,826,806 B2 * 12/2004 Eaton et al. ..... 24/115 F
6,848,288 B1 2/2005 Derman
6,859,982 B1 * 3/2005 Carrillo ..... 24/584.1
2003/0121129 A1 * 7/2003 Hamilton ..... 24/615
2003/0131450 A1 * 7/2003 Turesin ..... 24/3.6
2005/0125970 A1 * 6/2005 Nolan ..... 24/615
2006/0090309 A1 * 5/2006 Southern ..... 24/614

* cited by examiner

SEPARABLE CONNECTOR FOR KEY RINGS AND SIMILAR ARTICLES

RELATED APPLICATIONS

This application claims the benefit of U.S. Provisional Patent Application No. 60/698,296 filed on 11 Jul. 2005.

BACKGROUND OF THE INVENTION a. Field of the Invention

The present invention relates generally to separable connectors for key rings and like articles and, more particularly to a separable plastic connector that is formed of two identically-shaped members.

b. Related Art

Separable, or "pull-apart", key holders are devices that allow two sets of keys to be carried together, but to be separated when desired. Characteristically, the holders have a body that comes apart into two pieces, each with its own ring (e.g., a spiral-type split ring) for holding keys. The advantages of having a detachable key holder are well known: For example, an automobile driver may have a vehicle's keys attached to one end of the key holder and house keys and other personal keys attached to the other end, so that the latter can be disconnected and kept by the driver when leaving the vehicle keys with a parking attendant. In other situations, a person may want to disconnect one group of keys temporarily from the others for the reason of carrying less bulk or weight.

Examples of prior separable key holders include the devices shown in U.S. Pat. Nos. 1,199,690 (Gillan); 2,599,660 (Poutinen); 2,676,822 (Modrey); 2,702,928 (Nielsen); 4,713,951 (Ros); and 4,776,191 (MacDonald). Many of these devices are for practical purposes limited to metal construction, which, while durable, can be excessively expensive, especially if the product is intended as a promotional or "giveaway" item. Moreover, many employ locking mechanisms based on plungers and various other spring-loaded mechanisms, which again add greatly to the cost of manufacture. Others have used magnetic connections, which are again expensive and require the use of metal component or inserts; examples include the devices shown in U.S. Pat. Nos. 2,975,497 (Budreck) and 6,848,288 (Derman).

Some two-part key holders have been designed that are suitable to be constructed of molded plastic. Examples include those shown in U.S. Pat. Nos. 3,600,917 (Krock); 3,979,934 (Isenmann); 4,422,315 (Klose); 4,581,910 (Brooks et al.); and D310,753 (Stillwagon et al.). As a group, prior devices of this type are "fiddly" and inconvenient to operate, especially since it is typically necessary to carefully align the parts so that they can be reinserted or otherwise put back together. Moreover, in almost all of the devices the two pieces have different shapes and therefore require designing and making a second mold, as well as supplying and handling two different parts during assembly, adding cost and therefore somewhat offsetting the savings of plastic construction. U.S. Pat. No. 5,261,257 (Collier) shows a device that does use identically-shaped pieces, however, assembly of the two pieces is cumbersome and the reliability of the locking mechanism is dubious; moreover, the configuration of the parts is such that the surfaces are generally unsuitable for the application of advertising or other promotional information.

Accordingly, there exists a need for a separable key holder that is economically constructed of molded plastic material, yet which is convenient to use and does not require careful alignment of parts during reassembly. Furthermore, there exists a need for such a key holder in which the two parts of the body are identically shaped, so as to eliminate the cost of having to construct a second mold. Still further, there exists a need for such a key holder that establishes a secure, reliable lock between the two parts so as to avoid the potential for inadvertent separation. Still further, there exists a need for such a key holder that provides broad, essentially flat, well-proportioned surfaces for application of advertising or other promotional information. Still further, there exists a need for such a key holder that is strong, and that is durable and long-lasting in use.

SUMMARY OF THE INVENTION

The present invention has solved the problems cited above and is a separable holder for keys and similar articles. Broadly, the holder comprises: First and second identically shaped body members that are mounted in reversed, face-to-face relationship; bearing faces formed on the body members that mate to permit longitudinal sliding movement between the body members, first locking portions formed at first ends of the bearing faces; second locking portions formed at second ends of said bearing faces that receive said first locking portions in a detachable locked engagement therewith; and attachment portions formed on the body members for attachment of keys and similar articles thereto.

The body members may be formed of a substantially rigid, resiliently flexible material. The rigid, resiliently flexible material may comprise a molded plastic material.

The bearing faces may comprise generally flat, planar bearing surfaces. The second locking portions may comprise openings formed proximate the second ends of the bearing faces for passage of the first locking portions therethrough, and the first locking portions may comprise tongue portions that project from the first ends of the bearing faces so as to pass through the openings of the second-locking portions.

There may be notch portions formed on the openings and on the tongue portions that form a releasable interlocking engagement between the body members. The interlocking notch portions may comprise wall portions formed on the openings and on the tongue portions, the wall portions extending substantially normal to the planar bearing surfaces and meeting in face-to-face abutment so as to form the interlocking engagement.

The first and second locking portions may be resiliently deflectable so as to permit the body members to be separated by pulling distal ends thereof apart with a predetermined force. The body members may be formed of a plastic material having sufficient strength and flexibility that the material will not suffer appreciable wear or damage over multiple separation and locking cycles. The plastic materials may be selected from polycarbonate and nylon materials.

The openings of the second locking portions may comprise upper edges that span the openings, and the tongue portions further comprise tapered upper surfaces that react against the upper edges so as to resiliently force the tongue portions to a depressed position when passing through the openings. The walls of the first locking portion may be formed at rearward ends of the tapered upper surfaces, so that the tongue portions are released from the depressed position so as to position the walls in face-to-face abutment when the tongue portions have passed through the openings.

The body members may further comprise thin, web-shaped base portions that join the locking tongue portions to the bearing faces so as to enable the tongue portions to flex resiliently in a direction normal thereto.

The body members may further comprise broad, substantially planar display surfaces formed on sides of the body members opposite the bearing faces for application of promotional information thereto.

The holder may further comprise means for establishing longitudinal alignment between the body members. The means for establishing longitudinal alignment between the body members may comprise at least one longitudinally extending rib formed on each of the bearing surfaces, and at least one longitudinally extending channel formed in each of the bearing surfaces that receives the rib on the other bearing surface in longitudinally sliding engagement therewith.

The attachment portions may comprise openings formed through distal ends of the body members. The openings may each comprise a main opening for receiving an attachment ring, and first and second slot portions that extend forwardly along longitudinal sides of tab portions so as to form narrowed, flexible support sections that are sufficiently flexible that the body members can be separated by pulling the distal ends of the body members apart with a predetermined force.

These and other features of the present invention will be more fully understood from a reading of the following detailed description with reference to the accompanying drawings.

DETAILED DESCRIPTION

Figure 1:
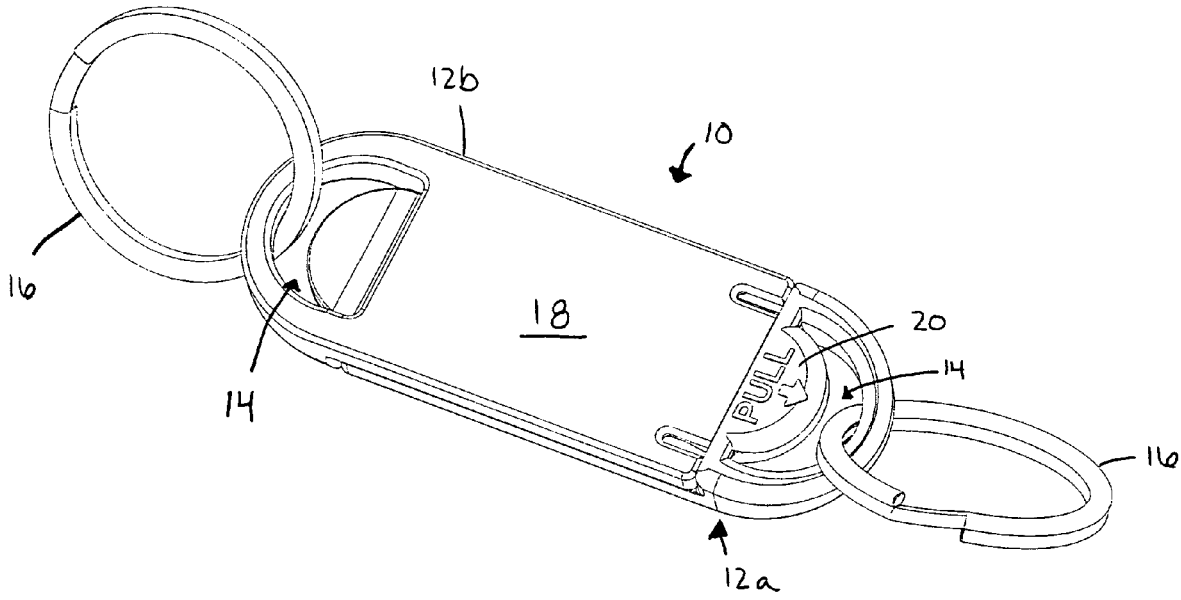
FIG. 1 is a perspective view of a separable key holder in accordance with the present invention, including key rings with which the holder may be provided.

FIG. 1 shows a detachable key holder 10 in accordance with the present invention. The body includes two identical thin, flat body members 12*a*, 12*b* that are joined in overlapping, face-to-face relationship; as will be described in greater detail below, the body members are suitably molded of a strong but slightly flexible plastic material, such as polycarbonate or nylon.

Each of the body members includes an attachment opening 14 in its distal end that receives and retains an attachment ring or chain, such as the spiral-type split rings 16 that are shown in FIG. 1. The sides of the members, in turn, form broad, flat display surfaces 18, so that advertising, logos, or other promotional information can readily be displayed on both sides of the holder.

As will be described in greater detail below, the body members can be separated by pulling apart with a firm tug on the two groups of keys or their respective rings. Reassembly is then performed by simply pressing and sliding the two body members together, with features on the members cooperating to guide them together with minimal need for alignment by the user.

Figure 2A:
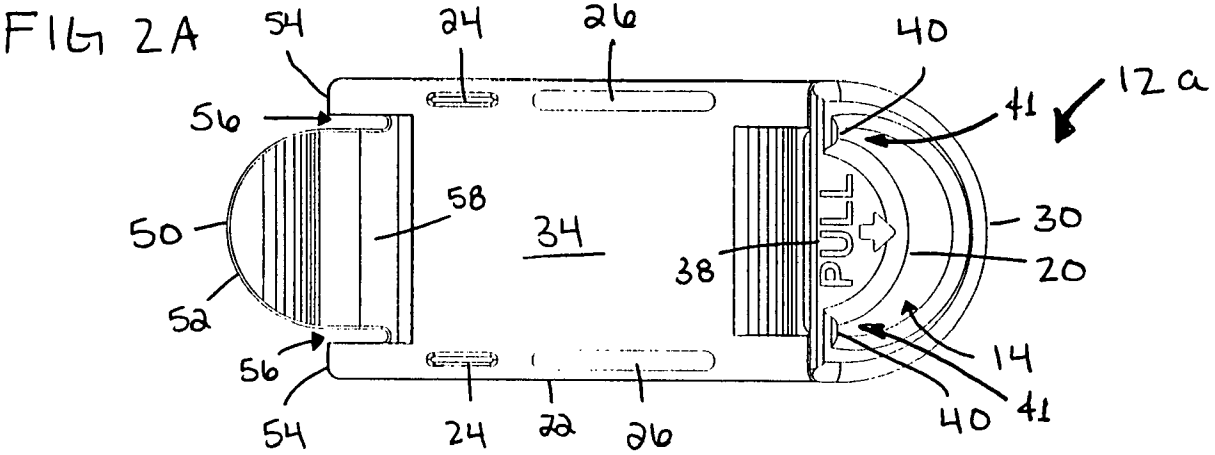
FIGS. 2A-2B are top and bottom plan views of one of the two body members of the separable key holder of FIG. 1, the other body member being identical thereto.
Figure 2B:
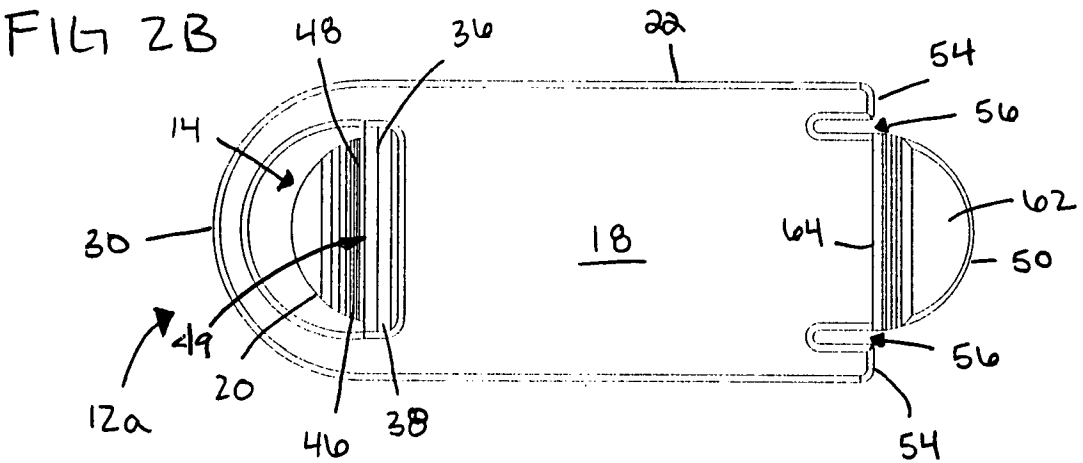

As can be seen in FIGS. 2A-2B, each of the two body members includes a thin, generally planar plate portion 22 that is somewhat rectangular in plan view. Two longitudinally-extending, parallel ribs 24 are formed along the side edges, and are received by cooperating guide grooves 26 that are coaxially aligned therewith. Positioning the ribs and grooves along the edges of the plate as shown prevents them from interfering visually with the display area 18 when the connector is made of a transparent material, however, it will be understood that they may be positioned more towards the centerline (or there may be only a single rib and groove). Moreover, the plate portion 22 may have other shapes (e.g., oval), in addition to the rectangular form that is shown.

Figure 3:
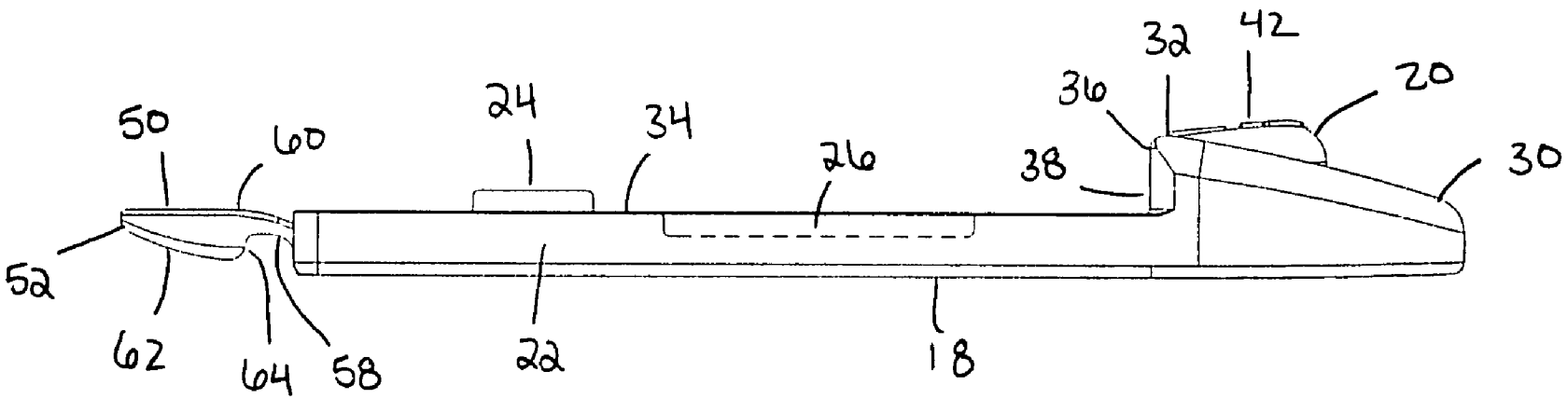
FIG. 3 is a side, elevational view of the body member of FIGS. 2A-2B, showing the structure thereof in greater detail.

A hoop 30 at one end of the plate portion 22 defines the key ring opening 14. As can be seen in FIG. 3, the base 32 of the hoop is raised above the plane of the bearing surface 34 of the plate portion 22, on a bridge piece 36 that spans a through-opening 38 (see FIG. 2A). The tab portion 20 extends rearwardly from the bridge portion, above the through opening, and is supported on two narrowed support sections 40, that are formed where forwardly-projecting slot portions 41 of the ring opening extend from the main aperture towards the bridge piece on either side of the tab portion. The reduced cross-section of the material in sections 40 provides a degree of flexibility that enables the tab and bridge portion to deflect downwardly as the body members separate, as will be described in greater detail below. The upper surface 42, of the tab provides a rest and grip surface for the user's thumbs when assembling/separating the members, and may be provided with a suitable legend, e.g., "Pull" as shown in the figures. The lower surface 46 of the tab in turn has a concave, upward curvature until it meets a transverse, depending wall 48, that forms a first locking notch 49 at the rearward side of the bridge portion 36.

A projecting tongue portion 50 is formed on the forward end of the plate portion, opposite the tab 20. As can be seen in FIGS. 2A-2B, the tongue portion includes a rounded leading edge 52, and side edges that are separated from the adjoining ends 54 of the plate portion by longitudinally extending slots 56. As can be seen in FIG. 3, the base portion 58 that connects the tongue to the main plate is web-shaped and is formed of relatively thin material, that (in combination with the edge slots 56) enables the tongue to flex resiliently in a direction perpendicular to the plate 22.

As can be seen with further reference to FIG. 3, the tongue portion has a flat upper surface 60 that extends substantially coplanar with the surface 34 of the plate portion. The lower surface 62, in turn, is convexly contoured, sloping downwardly and rearwardly from the relatively thin leading edge 52 to a generally perpendicular wall 64 that defines a second locking notch between the tongue and its base portion 58.

Figure 4A:
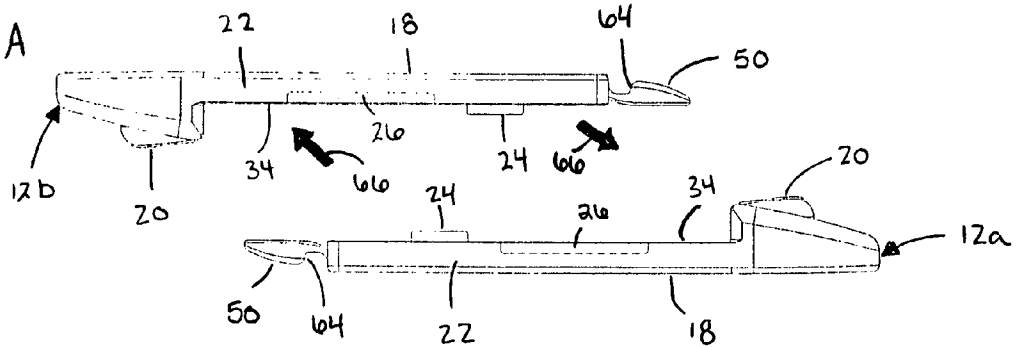
FIGS. 4A-4C are sequential, elevational views showing the steps of joining the two identical body members to form the complete key holder of FIG. 1.

To assemble the holder, the two body members are simply positioned in inverted, opposing relationship, with the upper surfaces 34 of the plate portions facing as shown in FIG. 4A, and then brought together in the direction generally indicated by arrows 66. Once this is done, the alignment ribs 24 enter the channels 26 of the opposite member, with the members being slipped slightly in a sideways direction to bring the ribs and grooves together, if necessary.

Figure 4B:
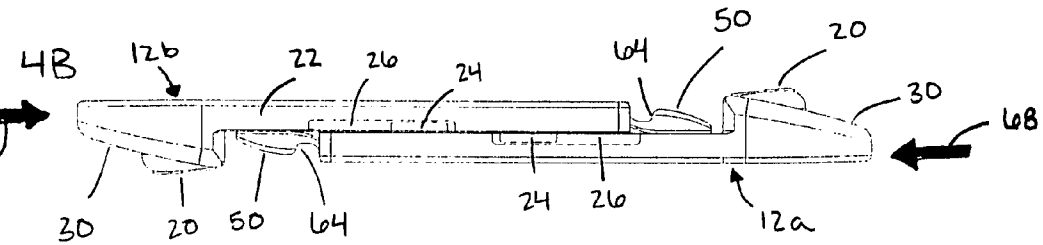

The two body members are then pressed and slid together in a longitudinal direction, as indicated generally by arrows 68 in FIG. 4B, so that the tongue portions 50 enter and pass through the receiver openings 38. As this is done, the curved, tapered surfaces of the tongue portions 50 react with the horizontal edges of the bridge portions that overlie the openings, so that the bases 58 of the tongue portions deform resiliently and the tongue portions are deflected in a direction generally perpendicular to that of the engagement surfaces 34. The tongue portions are then forced to a depressed position on which they pass through the openings 38. Further pressure moves the rearward walls 64 of the tongues past the walls 48 of the bridge portions (see FIG. 2B), at which point the resiliently deflected tongue portions "snap" back behind the bridge portions so as to position the two sets of walls 48, 64 in face-to-face, locking abutment; the faces of the walls 48, 64 preferably extend generally perpendicular to the main plane of the plate portions, so that the walls abut in a manner that effectively resists accidental separation of the body members, although one or both of the walls may in some embodiments be provided with a slight slope to help facilitate intentional separation, as will be described below. The forward motion of the body members, in turn, is arrested by abutment of the end portions 54 of the plate members 22 with the forward surfaces of the bridge portions 36.

Figure 4C:
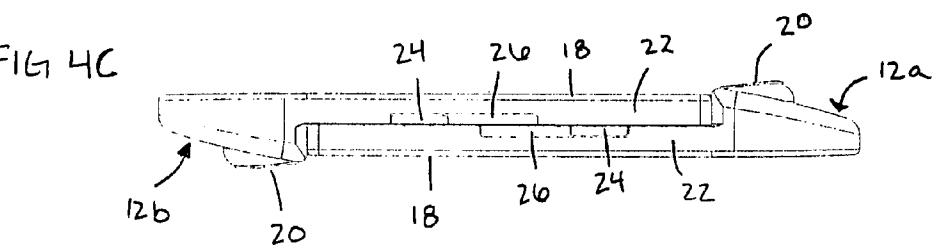

In FIGS. 4A-4C, the connecting movements appear as a series of distinct steps. In practice, however, connection is accomplished in a quick, continuous movement, with virtually no "fiddling" being required; as noted above, only a slight bit of side-to-side slipping is ordinarily needed, with the curved forward edges 52 of the tongue portions cooperating with the openings 38 to help achieve a rapid, almost automatic alignment.

Separating the holder 10 is accomplished by simply grasping the keys and/or rings at the two ends of the assembly and giving a quick tug in opposite directions, i.e., in directions opposite the arrows 68 in FIG. 4B. The force generated between the abutting walls 48, 64 produces temporary torsional loading that causes the flexible support sections to yield and twist resiliently so that the rearward walls 48 of the bridge portions swing/pivot so as to be angled away from the walls 64 on the tongue portions, while at the same time the base portions 58 of the tongues deflect outwardly resiliently, thus disengaging the locking notches. The two body members are then simply slipped apart, generally in the reverse of the movements shown in FIGS. 4B-4A.

The force required to separate the body members in this manner (i.e., when pulling apart on bunches of keys) is preferably in a range of approximately 7-9 lbs (approximately 3-4 kgs), such that the locking strength is sufficient to prevent accidental separation yet low enough that the two pieces can easily be separated by an adult. It will be understood that the required force can be adjusted upwardly or downwardly by increasing or decreasing the amount of material in the flexible supports, i.e., the narrowed sections 40 and the base web 58. Moreover, it will be noted that the preferred polycarbonate and nylon materials generally exhibit high strength and excellent wear resistance, as compared with other, more fragile plastics; as a result, there is no risk of damage to the plastic body members when they are pulled apart by a quick tug as described above and even over many attachment/detachment cycles there will be little or no wear on the locking notches.

As noted above, the two narrowed support sections 40 are formed by slot portions 41 that flank the tab portions 20. An advantage of this configuration is that the narrowed sections 40, form in effect, small live hinges that enable the bridge pieces to rotate so that the walls 48 pivot to the sloped/angled release position, while the added material of the tab portions behind the main spans of the walls provides rigidity that ensures the walls will pivot uniformly across their entire width, without bending or bowing in a manner that would interfere with a clean release or possibly lead to breakage. It will be understood, however, that the tab portions may have other configurations or may not be present in all embodiments. Moreover, in some embodiments the tabs may include projecting contact portions on their lower sides that press downwardly against the tongue portions 50 when squeezed between a thumb and forefinger so as to move the walls 48, 64 out of engagement, thus providing an optional finger-pressure operated release mechanism in addition to the pull-apart release described above.

The present invention thus provides a holder that is strong and durable, yet which is extremely economical to manufacture owing to the use of only two, identically-shaped parts. The broad, flat display surfaces 18 on the side of the assembled holder provide optimal areas for the display of logos or other promotional information that can be applied, for example, by printing, stamping, or adhesion. Moreover, even though the parts are molded only in a single shape, they can be molded in different colors of plastic so that the two "halves" can be made in different colors; for example, if a company's logo is primarily red and white, it may be desirable to manufacture the "halves" in red and white to emphasize the corporate colors in a promotional product. Furthermore, especially vivid transparent colors can be produced when using polycarbonate material.

It is to be recognized that various alterations, modifications, and/or additions may be introduced into the constructions and arrangements of parts described above without departing from the spirit or ambit of the present invention as defined by the appended claims.

What is claimed is:

1. A separable holder for keys and similar articles, said holder comprising:

first and second identically-shaped body members that are formed of a substantially rigid, resiliently flexible material and are mounted in reversed, face-to-face relationship;

bearing faces formed on said body members that meet to permit longitudinal sliding movement between said body members, said bearing faces comprising generally flat, planar bearing surfaces;

first locking portions formed at first ends of each of said bearing faces;

second locking portions formed at second ends of said bearing faces that receive said first locking portions in detachably locked engagement therewith;

said second locking portions comprising openings formed proximate said second ends of said bearing faces for passage of said first locking portions therethrough, said openings comprising upper edges that span said openings;

said first locking portions comprising tongue portions that project from said first ends of said bearing faces so as to pass through said openings of said second locking portions, said tongue portions of said first locking portions comprising tapered upper surfaces that react against said upper edges of said openings so as to resiliently flex said tongue portions to depressed positions when passing through said openings;

notch portions formed on said openings and on said tongue portions that form a releasable interlocking engagement between said body members, said interlocking notch portions comprising wall portions formed on said openings and on said tongue portions, said wall portions extending generally perpendicular to said planar bearing surfaces and meeting in face-to-face abutment so as to form said interlocking engagement, said wall portions on said tongue portions being formed at rearward ends of said tapered upper surfaces, so that said tongue portions are released from said depressed positions so as to position said wall portions on said tongue portions and said openings in face-to-face abutment when said tongue portions have passed through said openings;

said body members further comprising thin, web-shaped base portions that join said tongue portions to said bearing faces so as to enable said tongue portions to flex resiliently in a direction generally normal thereto; and attachment portions formed on said body members for attachment of keys and similar articles thereto.

2. The holder of claim 1, wherein said rigid resiliently flexible material comprises a molded plastic material.

3. The holder of claim 1, wherein said first and second locking portions are resiliently deflectable so as to permit the body members to be separated by pulling distal ends thereof apart with a predetermined force.

4. The separable holder of claim 1, wherein said body members further comprise:

broad, substantially planar display surfaces formed on sides of said body members opposite said bearing faces for application of promotional information thereto.

5. The separable holder of claim 1, further comprising:

means for establishing longitudinal alignment between said body members.

6. The separable holder of claim 5, wherein said means for establishing longitudinal alignment between said body members comprises:

at least one longitudinally extending rib formed on each of said bearing surfaces; and at least one longitudinally extending channel formed in each of said bearing surfaces that receives a rib on the other bearing surface in longitudinally sliding engagement therewith.

7. The separable holder of claim 1, wherein said attachment portions comprise:

attachment openings formed through ends of said body members.

8. The separable holder of claim 1, wherein each of second locking portions comprises:

a bridge portion that spans said opening and has one of said wall portions formed thereon; and first and second narrowed, flexible support sections at ends of said bridge portion that enable said wall portion thereon to pivot towards a release portion in response to pulling distal ends of said body members apart.

9. The separable holder of claim 8, wherein said narrowed support sections are sufficiently flexible that said body members can be separated by pulling said distal ends of said body members apart with a predetermined force.

10. The separable holder of claim 9, wherein said predetermined force is in the range from about 3-4 kilograms.

11. A separable holder for keys or similar articles, said holder comprising:

first and second identically-shaped body members that are mountable together in reversed, face-to-face relationship, each of said body members being formed of a substantially rigid, resiliently flexible material and comprising:

a generally flat, planar bearing surface for meeting with said bearing surface on the other body member so as to permit longitudinal sliding movement between said body members;

a display surface for display of promotional or other information, formed on a side of said body member opposite said bearing surface;

at least one longitudinally extending rib formed on said bearing surface;

at least one longitudinally extending channel formed in said bearing surface for receiving said rib on the other body member in sliding engagement so as to establish longitudinal alignment between said body members;

a tongue portion that projects longitudinally from said bearing surface at a first end of said body member, said tongue portion comprising:

a tapered upper surface on a side of said body member opposite said bearing surface that tapers distally towards said bearing surface;

a locking notch formed at an anterior end of said tapered upper surface; and a flexible base portion that joins said tongue portion to said bearing surface so as to enable said tongue portion to flex in a direction generally normal thereto;

a receiver portion that projects upwardly from said bearing surface at a second end of said body member for receiving said tongue portion of the other body member in locking engagement therewith, said receiver portion comprising:

an opening for passage of said tongue portion of the other body member therethrough in a longitudinal direction;

a bridge portion extending over said opening and having a lower edge for reacting against said tapered upper surface of said tongue portion of the other body member so as to resiliently depress said tongue portion in response to said tongue portion passing through said opening, said lower edge terminating on a distal side of said bridge portion so as to allow said tongue portion of the other body member to rise resiliently in response to passing behind said bridge portion;

a locking notch formed on a distal side of said bridge portion for engaging said locking notch on said tongue portion of the other body member in response to said tongue portion rising resiliently after passing behind said bridge portion; and first and second narrowed, flexible support sections at ends of said bridge portion that enable said bridge portion to rotate so as to disengage said locking notches in response to pulling distal ends of said body members apart with a predetermined force; and an attachment opening on an end of said body members for attachment of articles thereto.

12. A separable holder for keys and similar articles, said holder comprising:

first and second identically-shaped body members that are formed of a substantially rigid, resiliently flexible material and are mounted in reversed, face-to-face relationship;

bearing faces formed on said body members said bearing faces comprising generally flat, planar bearing surfaces that meet to permit longitudinal sliding movement between said body members;

first locking portions formed at first ends of each of said bearing faces;

second locking portions formed at second ends of said bearing faces that receive said first locking portions in detachably locked engagement therewith;

said second locking portions comprising openings formed proximate said second ends of said bearing faces for passage of said first locking portions therethrough, and said first locking portions comprising tongue portions that project from said first ends of said bearing faces so as to pass through said openings of said second locking portions;

notch portions formed on said openings and on said tongue portions that form a releasable interlocking engagement between said body members, said interlocking notch portions comprising wall portions formed on said openings and on said tongue portions that extend generally perpendicular to said planar bearing surfaces and that meet in face-to-face abutment so as to form said interlocking engagement;

each of said second locking portions comprising a bridge portion that spans said opening and has one of said wall portions formed thereon and first and second narrowed, flexible support sections at ends of said bridge portion that enable said wall portion thereon to pivot towards a release portion in response to pulling distal ends of said body members apart; and attachment portions formed on said body members for attachment of keys and similar articles thereto.

13. The separable holder of claim 12, wherein said narrowed support sections are sufficiently flexible that said body members can be separated by pulling said distal ends of said body members apart with a predetermined force.

14. The separable holder of claim 13, wherein said predetermined force is in the range from about 3-4 kilograms.

* * * * *